United States Patent [19]

James

[11] 4,053,390

[45] Oct. 11, 1977

[54] START-UP PROCEDURE FOR A RESIDUAL OIL PROCESSING UNIT

[75] Inventor: Lewis C. James, Ras Tanura, Saudi Arabia

[73] Assignee: Cities Service Research and Development Company, Tulsa, Okla.

[21] Appl. No.: 641,394

[22] Filed: Dec. 17, 1975

[51] Int. Cl.[2] ..... C10G 13/02; C10G 23/10

[52] U.S. Cl. ..... 208/143; 208/108; 208/157

[58] Field of Search ..... 208/143, 157, 108

[56] References Cited

U.S. PATENT DOCUMENTS

| | | | |
|---|---|---|---|
| 3,271,301 | 9/1966 | Galbreath | 208/143 |
| 3,281,352 | 10/1966 | Schuman | 208/143 |

*Primary Examiner*—Herbert Levine

*Attorney, Agent, or Firm*—George L. Rushton

[57] ABSTRACT

In starting up an upflow, ebullated bed hydroprocessing reactor, a light oil is used, to establish an ebullating bed. As heavy residual feedstock is incrementally substituted, the ebullating pump speed and gas flow rate need to be monitored and adjusted for smooth operation. By knowing and controlling the viscosity and density of the feedstock, flow variations inside the reactor can be minimized, resulting in a constant pump speed and gas flow rate.

1 Claim, No Drawings

START-UP PROCEDURE FOR A RESIDUAL OIL PROCESSING UNIT

BACKGROUND OF THE INVENTION

This invention concerns an improved start-up procedure for a processing unit. More particularly, the procedure concerns an upflow, ebullated bed reactor for the hydroprocessing of heavy hydrocarbon residues. The utility of the invention lies in an improved method of operating a hydroprocessing reactor, especially during start-up and shut-down periods.

Prior art methods of start-up procedures for ebullated bed, heavy hydrocarbon residue processing units are exemplified by U.S. Pat. Nos. 3,244,617 (Galbreath), 3,491,017 (Rapp), and 3,491,018 (Schuman). The first of these procedures tries to control the rate of conversion, or hydrogenation, during start-up by controlling the temperature and residence time in the reactor in order to minimize external heat input, thereby reducing construction costs and operating expenses. The latter procedures, respectively, control conversion to less than about 40 vol.% until about 3 bbl. of heavy feedstock/lb. new catalyst have been processed, by reactor temperature control to present premature deactivation of the catalyst, and by increasing the reactor temperature and space velocity to promote a constant conversion rate of at least 75 vol.%.

Broadly, a typical start-up procedure for the hydroprocessing of heavy hydrocarbon residue in an upflow, ebullated bed reactor comprises:

- blowing hot gas through a charge of catalyst in the reactor, to heat the reactor and contents. This takes about 24–48 hours.
- adding a light gas oil of about 350°–750° F. boiling range. This step forms and maintains an ebullated bed and takes about 4–24 hours.
- phasing in the heavy hydrocarbon residue, while maintaining the top of the catalyst bed at a relatively constant height while heating the reactor inventory. This takes 8–24 hours.
- establishing final operating parameters.

It is noted that this typical procedure is modified for times, rates, temperatures, etc. for different feedstocks, with these modifications being known or calculated from previous runs or from pilot plant studies.

SUMMARY OF THE INVENTION

I have now discovered an improvement in the start-up procedure, with the major benefit being that close monitoring of the ebullating pump rate is not necessary. By knowing the characteristics of the starting light oil feed and of the planned residual feedstock, specifically the viscosity and specific gravity, I can carry out a smooth start-up of an upflow, ebullated bed reactor using a heavy hydrocarbon residue feedstock. The procedure involves the above-listed steps, with the improvement comprising controlling the viscosity and specific gravity of the light oil stream, the heavy hydrocarbon residue stream, and mixtures of the two to a range of about ± 10% for viscosity and about ± 5% for density. By using this procedure, an ebullating pump rate and gas flow rate to the reactor are initially established, and, following the steps of incrementally substituting heavy residue for the light oil and establishing temperature, pressure, and flow parameters, it has been found that monitoring of the ebullating pump rate and gas flow rate is not essential. Thus, a smooth start-up is obtained with fewer complications than in prior procedures.

DESCRIPTION OF THE PREFERRED EMBODIMENTS

The major parameters involved in the upflow, ebullated bed hydroprocessing of heavy hydrocarbon residues are disclosed in the above-mentioned U.S. patents, which are hereby incorporated by reference. All of these parameters enter in the operation of the reactor, and many of them, such as various temperatures, pressures, flow rates, etc. are monitored closely, especially during start-up.

From prior information, I know or can calculate the viscosity and specific gravity of various feedstocks, including mixtures of light oils and heavy residues. By controlling the viscosity about ± 10% and the density about ± 5% and correlating these data with other parameters during start-up, I have established an improved start-up procedure. By maintaining the liquid viscosity and specific gravity relatively constant, it is no longer necessary to change the ebullating pump speed to maintain a constant catalyst bed expansion, thus allowing closer monitoring of the other operating parameters. For new and different feedstocks, certain basic information must be obtained, after which the new feedstocks can be used in the operation of this invention.

By maintaining a relatively constant ebullating pump speed and gas flow rate, the catalyst bed in the upflow reactor is kept at a relatively constant level of expansion. Since the pump operates on a mixture of reactor recycle liquid and fresh feed, a relatively constant velocity for the ternary mixture of gas, liquid and solid is desired. And the relation between the velocity and the viscosity and density of the fluid mixture is shown by $$V = \left[\frac{\rho_p - \rho_f}{\rho_f}\right]^x [\mu_f]^c$$

where

- V = superficial liquid velocity in the reactor (gpm/ft²)
- $\rho$ = density of wetted catalyst particle (gm/cc)
- $\rho$ = density of liquid (gm/cc)
- $\mu$ = viscosity of reaction liquid (centipoise)
- X and C are constants, the values depending on the characteristics of the different feedstocks.

During an orderly shut-down, the same concepts and procedures apply. The heavy residual feed is cut back, and a lighter oil is substituted in the feedstream. When the total feed is light oil, operating parameters are adjusted until complete shut-down is reached.

The examples below illustrate two start-ups—one using a typical prior art procedure and the other using the invention. Both examples used the same reactor, auxiliary equipment, hydrogen supply, light cycle oil supply, and heavy gas oil feedstock. The heavy gas oil was considered as one of the typical heavy hydrocarbon residual feedstocks. The preliminary steps of catalyst loading and heat-up with hot hydrogen were equivalent for each example.

EXAMPLE I

With the upflow, ebullated bed reactor at operating temperature and pressure, light cycle oil was started to the reactor, to fill the reactor to the operating level and to establish an expanded catalyst bed. A constant gas rate was maintained.

a. At T+ 22 hrs., light cycle oil rate was increased by 33%. (Pump speed controlled to give a 35% expansion of bed throughout rest of start-up.)

b. At T + 25 hrs., started heavy gas oil, with a mixed feedstream of 12.5% HGO and 87.5% LCO.

c. At T+ 26hrs., altered feed to 25% HGO and 75% LCO.

d. At T + 27 hrs., altered feed to 37.5% HGO and 62.5% LCO.

e. At T + 28 hrs., altered feed to 50% HGO and 50% LCO. Catalyst carryover, due to over-expansion of the bed, was noted shortly after this change was made.

EXAMPLE II

A constant gas rate and constant ebullating pump rate were set and maintained to give a 35% expansion. The table below shows how, by controlling the viscosity and density of the feedstream, a rapid start-up was successfully completed.

| Time (hrs.) | %LCO | %HGO | Relative Viscosity ($\mu$) | Relative Density($\rho$) |
|---|---|---|---|---|
| T | 100 | 0 | 0.95 | 1.04 |
| T + 1 | 80 | 20 | 0.98 | 1.02 |
| T + 2.5 | 66.6 | 33.4 | 1.00 | 1.00 |
| T + 3.8 | 53.3 | 46.7 | 1.03 | 0.99 |
| T + 5 | 40 | 60 | 1.05 | 0.99 |
| T + 6 | 26.7 | 73.3 | 1.06 | 0.98 |
| T + 8 | 13.3 | 86.7 | 1.09 | 0.96 |

-continued

| Time (hrs.) | %LCO | %HGO | Relative Viscosity ($\mu$) | Relative Density($\rho$) |
|---|---|---|---|---|
| T + 9 | 0 | 100 | 1.09 | 0.96 |

After continuous operations for some time on HGO, vacuum residuum was incrementally substituted. An extended run was then made on the new feedstock.

I claim:

1. In the start-up procedure for an upflow, ebullated bed reactor for the hydroprocessing of heavy hydrocarbon residues, involving charging the reactor with catalyst, heating the catalyst and reactor with pre-heated hydrogen to an operating range of about 700°-900° F. and about 1000-3000 psig hydrogen partial pressure, adding a light oil and additional hydrogen, with a recycle ebullating pump assisting the hydrogen in forming an expanded, ebullated catalyst bed, with said heating and addition taking a substantial period of time, and then adding heavy hydrocarbon residue, the improvement which comprises a. setting the hydrogen gas flow rate and the ebullating pump rate so as to maintain the expansion of the ebullated bed, b. incrementally substituting heavy hydrocarbon residue for the light oil feed stream until substantially all the light oil is replaced by heavy residue, and c. controlling the viscosity and specific gravity of the incrementally changing feed stream to a range of about ±10% for viscosity and about ±5% for specific gravity, thus maintaining a constant expansion of the ebullated bed, at a constant ebullating pump rate and gas flow rate throughout substitution of the heavy residue for the light oil.

* * * * *

UNITED STATES PATENT OFFICE

CERTIFICATE OF CORRECTION

Patent No. 4,053,390 Dated Oct. 11, 1977

Inventor(s) Lewis C. James

It is certified that error appears in the above-identified patent and that said Letters Patent are hereby corrected as shown below:

Col. 2, line 37 reads $V = \left[\frac{\rho_p - \rho_f}{\rho_f}\right]^x [\mu_f]^c$ should read $V = \left[\frac{\rho_p - \rho_f}{\rho_f}\right]^x [\mu_f]^c$ Col. 2, line 45 reads $\rho$=density of wetted should read $\rho_p$=density of wetted Col. 2, line 46 reads $\rho$=density of liquid (gm/cc)

should read $\rho_f$=density of liquid (gm/cc)

Col. 2, line 47 reads $\mu$ =viscosity should read $\mu_f$=viscosity

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*